US007339565B2

(12) United States Patent
Kim

(10) Patent No.: US 7,339,565 B2
(45) Date of Patent: Mar. 4, 2008

(54) METHOD AND APPARATUS FOR DRIVING LIQUID CRYSTAL DISPLAY DEVICE

(75) Inventor: Ki Duk Kim, Kunpo-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 683 days.

(21) Appl. No.: 10/747,690

(22) Filed: Dec. 30, 2003

(65) Prior Publication Data

US 2005/0001801 A1 Jan. 6, 2005

(30) Foreign Application Priority Data

Jun. 5, 2003 (KR) ..... 10-2003-0036289

(51) Int. Cl.
*G09G 3/36* (2006.01)

(52) U.S. Cl. ..... 345/88; 345/98

(58) Field of Classification Search ..... 345/99, 345/102, 100, 98, 87–89, 600–604; 348/671, 348/672

See application file for complete search history.

(56) References Cited

U.S. PATENT DOCUMENTS

2005/0104837 A1* 5/2005 Baik et al. ..... 345/99
2005/0140640 A1* 6/2005 Oh et al. ..... 345/102

FOREIGN PATENT DOCUMENTS

JP 2001-222264 8/2001
KR 1998-014689 5/1998

* cited by examiner

*Primary Examiner*—Ricardo Osorio
(74) *Attorney, Agent, or Firm*—McKenna Long & Aldridge LLP

(57) ABSTRACT

An apparatus of driving the liquid crystal display of the present invention includes a picture quality improving unit that receives input data for a frame, wherein the picture quality improving unit analyzes green input data to determine a brightness of the frame and performs a gamma compensation on the input data in accordance with the brightness of the frame to generate output data; and a timing controller that rearranges the output data to supply the rearranged output data to the data driver.

28 Claims, 8 Drawing Sheets

METHOD AND APPARATUS FOR DRIVING LIQUID CRYSTAL DISPLAY DEVICE

This application claims the benefit of Korean Patent Application No. 2003-36289, filed in Korea on Jun. 5, 2003, which is hereby incorporated by reference for all purposes as if fully set forth herein.

BACKGROUND OF THE INVENTION

1. Field of the Invention

The present invention relates to a method and an apparatus for driving a liquid crystal display device and more particularly to a method and an apparatus for driving a liquid crystal display device capable of improving the contrast of a display image.

2. Description of the Related Art

A liquid crystal display displays pictures by adjusting the light transmittance of liquid crystal cells in response to a video signal. The liquid crystal display is an active matrix type having a switching device in each cell and may be used as the display apparatus for a computer monitor, an office automation apparatus, and a cellular phone. A thin film transistor (hereinafter referred to as a "TFT") is typically used as a switching device in an active matrix liquid crystal display.

FIG. 1 schematically illustrates a driving apparatus of the liquid crystal display according to the related art. Referring to FIG. 1, the driving apparatus of the liquid crystal display of the related art comprises a liquid crystal panel 2, wherein m×n liquid crystal cells are arranged in a matrix, and wherein the number of data lines D1 to Dm is m and the number of gate lines G1 to Gn is n. The data and gate lines cross, and a TFT is formed at the interconnection. The driving apparatus also includes a data driver 4 that supplies a data signal to the data lines D1 to Dm of the liquid crystal panel 2, a gate driver 6 that supplies a scan signal to the gate lines G1 to Gn, a gamma voltage supplier 8 supplies a gamma voltage to the data driver 4, a timing controller 10 that controls the data driver 4 and the gate driver 6 by using a synchronization signal provided from a system 20, a DC/DC converter 14 that generates voltages supplied to the liquid crystal panel 2 by using a voltage supplied from a power supply 12, and an inverter 16 that drives a backlight 18.

The system 20 supplies to the timing controller 10 vertical/horizontal synchronization signal Vsync, Hsync, a clock signal DCLK, a data enable signal DE, and R, G and B data signals.

The liquid crystal panel 2 comprises a plurality of liquid crystal cells Clc arranged in a matrix created by the interconnection of the data lines D1 to Dm and the gate lines G1 to Gn. The TFTs in each liquid crystal cell Clc supplies the liquid crystal cell Clc the data signal supplied from the data lines D1 to Dm in response to the scan signal supplied from the gate line G. Further, each liquid crystal cell Clc has a storage capacitor Cst. The storage capacitor Cst is formed between a pixel electrode of the liquid crystal cell Clc and a previous gate line or may be formed between the pixel electrode of the liquid crystal cell Clc and a common electrode line and thereby maintains a voltage applied to the liquid crystal cell Clc.

The gamma voltage supplier 8 provides a plurality of gamma voltages to the data driver 4. The data driver 4 converts R, G, and B digital video data signals into an analog gamma voltage (data signal) corresponding to a gray scale value in response to a control signal Cs from the timing controller 10 and supplies this analog gamma voltage to the data lines D1 to Dm.

The gate driver 6 sequentially supplies a scan pulse to the gate lines G1 to Gn in response to the control signal CS from the timing controller 10 and selects a horizontal line of the liquid crystal panel 2 to which the data signal is supplied.

The timing controller 10 generates the control signal CS to control the gate driver 6 and the data driver 4 by using the vertical/horizontal synchronization signals Vsync and Hsync and the clock signal DCLK received from the system 20. The control signal CS that controls the gate driver 6 includes a gate start pulse GSP, a gate shift clock GSC, and a gate output enable GOE. The control signal CS that controls the data driver 4 includes a source start pulse GSP, a source shift clock SSC, a source output enable SOC, and a polarity signal POL. The timing controller 10 rearranges the R, G, and B data supplied from the system 20 to supply it to the data driver 4.

The DC/DC converter 14 increases or decreases the voltage level of a 3.3 V signal received from the power supply 12 and generates a voltage to be supplied to the liquid crystal panel 2. The DC/DC converter 14 generates a gamma reference voltage, a gate high voltage VGH, a gate low voltage VGL, and a common voltage Vcom.

The inverter 16 supplies a drive voltage (or a drive current) to drive the backlight 18. The backlight 18 generates a light level corresponding to the drive voltage (or the drive current) supplied by the inverter 16 to the liquid crystal panel 2.

In order to display dynamic pictures on the liquid crystal panel 2, it is desirable that the contrast should be as great as possible. However, there is not a method available that is capable of extending the contrast inherent in the display data on the liquid crystal display of the related art, and thus it is difficult to display dynamic pictures. Further in the related art, the backlight 18 of the liquid crystal display constantly and uniformly radiates irrespective of the data. If the backlight 18 constantly and uniformly radiates irrespective of the data, it is difficult to display dynamic and vivid pictures in the liquid crystal panel 2.

SUMMARY OF THE INVENTION

Accordingly, the present invention is directed to a method and apparatus for driving a liquid crystal display device that substantially obviates one or more of the problems due to limitations and disadvantages of the related art.

Accordingly, an advantage of the present invention is to provide a method and an apparatus for driving a liquid crystal display device capable of improving the visible contrast of a display image in accordance with an input data.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, an apparatus for driving liquid crystal display according to an aspect of the present invention includes a picture quality improving unit that receives input data for a frame, wherein the picture quality improving unit analyzes green input data to determine a brightness of the frame and performs a gamma compensation on the input data in accordance with the brightness of the frame to generate output data; and a timing controller that rearranges the output data to supply the rearranged output data to the data driver.

In another aspect of the present invention, an apparatus for driving a liquid crystal display having a data driver and a gate driver, includes an image signal modulation unit that analyzes input green data from input data for a frame to determine the brightness of the frame and that generates output data, wherein the brightness of the output data has been changed in accordance with the analyzed brightness to increase the contrast of the frame; a controller that modulates an input synchronization signal associated with the input data to generate a output synchronization signal to synchronize the output data; and a timing controller that rearranges the output data and that generates a driving control signal to be supplied to the data driver and the gate driver by using the output synchronization signal.

In another aspect of the present invention, a method of driving a liquid crystal display having a data driver, includes the steps of producing a brightness histogram using input green data of input data from a frame that indicates brightness information; performing a gamma compensation of the input data in order to increase contrast of the frame if an average value of the brightness information is higher than a predetermined reference value; and rearranging the compensated input data to supply to the data driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to embodiments of the present invention, examples of which are illustrated in the accompanying drawings.

Referring to FIGS. 2 to 8, embodiments of the present invention are explained.

Figure 1:
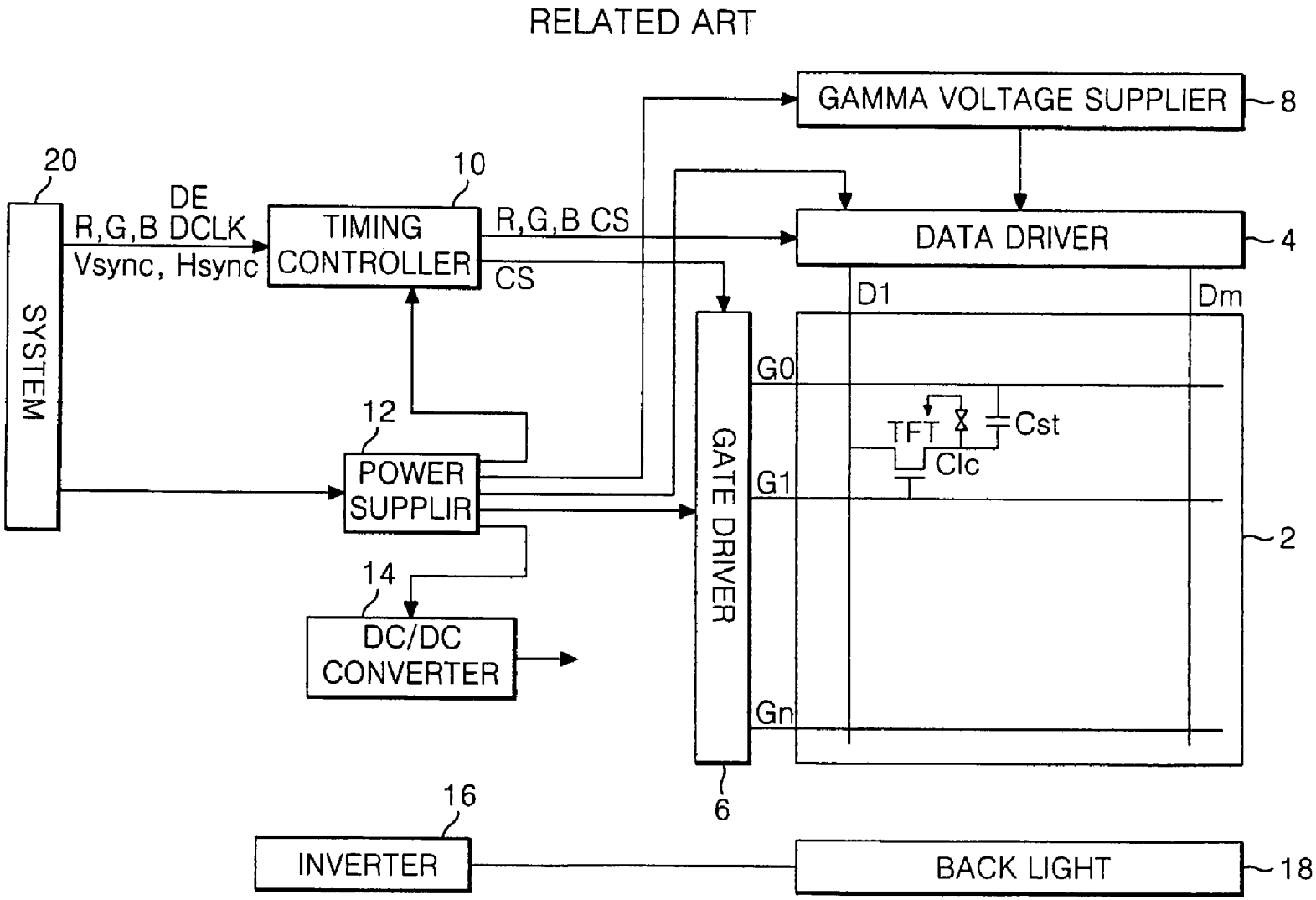
FIG. 1 RELATED ART
FIG. 1 illustrates a driving apparatus of a liquid crystal display of the related art.
Figure 2:
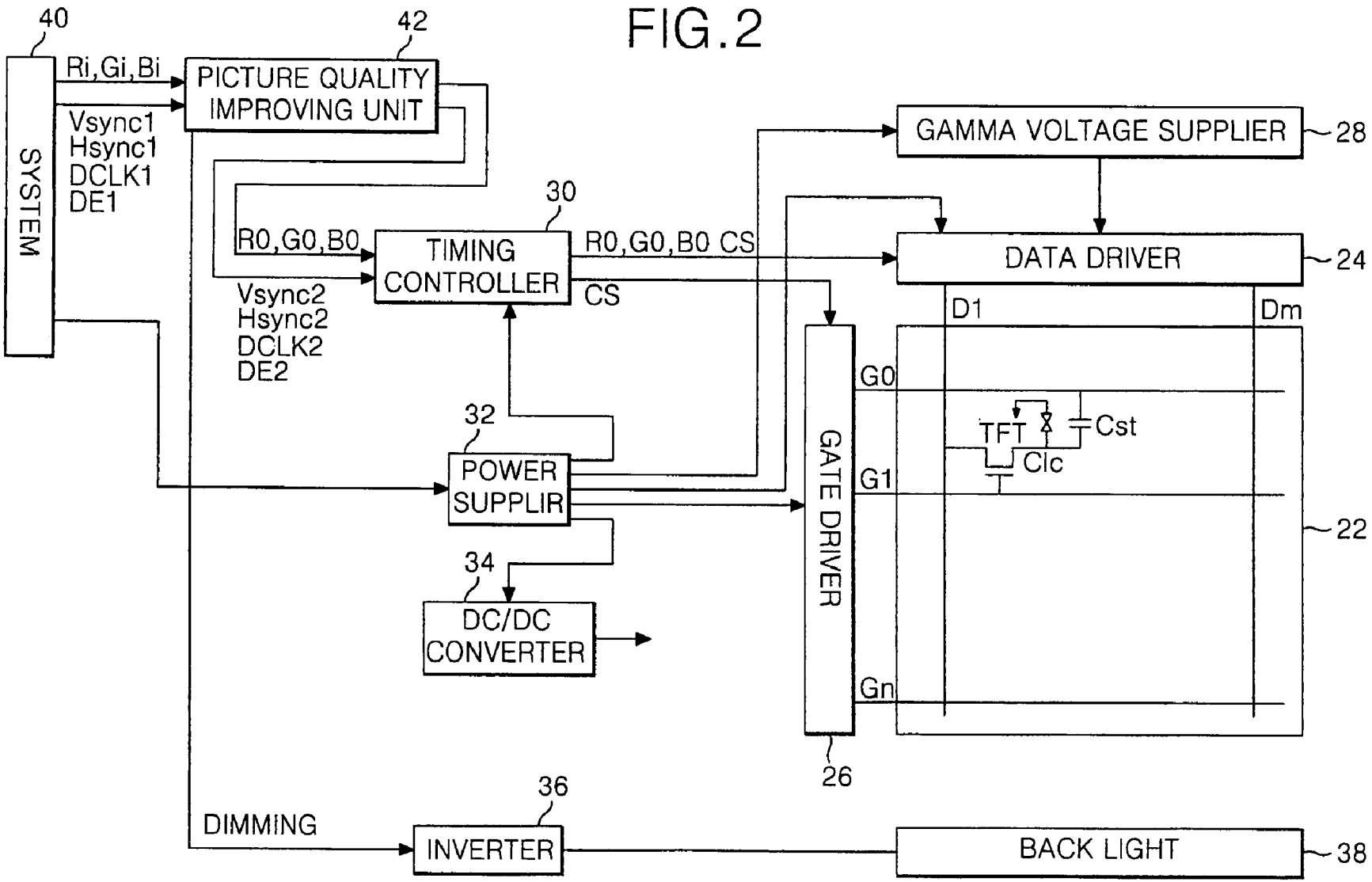
FIG. 2 illustrates a driving apparatus of a liquid crystal display according to an embodiment of the present invention.

FIG. 2 is a block diagram illustrating a driving apparatus of a liquid crystal display according to an embodiment of the present invention. Referring to FIG. 2, a liquid crystal display driving apparatus includes a liquid crystal panel 22 where m×n liquid crystal cells are arranged in a matrix and the number of data lines D1 to Dm is m and the number of gate lines G1 to Gn in n. At the interconnection of the data and gate lines, a TFT is formed. The driving apparatus also includes a data driver 24 that supplies a data signal to the data lines D1 to Dm of the liquid crystal panel 22, a gate driver 26 that supplies a scan signal to the gate lines G1 to Gn, a gamma voltage supplier 28 that supplies a gamma voltage to the data driver 24, a timing controller 30 that controls the data driver 24 and the gate driver 26 by using a second synchronization signal provided from a picture quality improving unit 42, a DC/DC converter 34 that generates voltages supplied to the liquid crystal panel 22 by using a voltage supplied from a power supply 32, an inverter 36 that drives a backlight 38, and a picture quality improving unit 42 that extends the contrast of input image data and in addition that supplies a brightness control signal (Dimming) corresponding to the input image data to the inverter 36.

The system 40 supplies to the picture quality improving unit 42 input vertical/horizontal synchronization signals Vsync1 and Hsync1, a input clock signal DCLK1, a input data enable signal DE1, and input Ri, Gi, and Bi data signals.

The liquid crystal panel 22 includes a plurality of liquid crystal cells Clc arranged in a matrix created by the interconnection of the data lines D1 to Dm and the gate lines G1 to Gn. The TFTs in each liquid crystal cell Clc supplies the liquid crystal cell Clc the data signal supplied from the data lines D1 to Dm in response to the scan signal supplied from the gate line G Further, each liquid crystal cell CLc has a storage capacitor Cst. The storage capacitor Cst may be formed between a pixel electrode of the liquid crystal cell Clc and a previous gate line or may be formed between the pixel electrode of the liquid crystal cell Clc and a common electrode line to thereby maintains a voltage applied to the liquid crystal cell Clc.

The gamma voltage supplier 28 provides a plurality of gamma voltages to the data driver 24. The data driver 24 converts Ro, Go, and Bo digital video data into an analog gamma voltage (data signal) corresponding to a gray scale value in response to a control signal Cs from the timing controller 30 and supplies this analog gamma voltage to the data lines D1 to Dm.

The gate driver 26 sequentially supplies a scan pulse to the gate lines G1 to Gn in response to the control signal CS from the timing controller 30 and selects a horizontal line of the liquid crystal panel 22 to which the data signal may be supplied.

The timing controller 30 generates the control signal (CS) to control the gate driver 26 and the data driver 24 by using the second vertical/horizontal synchronization signals Vsync2 and Hsync2 and the second clock signal DCLK2 received from the picture quality improving unit 42. The control signal CS that controls the gate driver 26 includes a gate start pulse GSP, a gate shift clock GSC and a gate output enable GOE. The control signal CS that controls the data driver 24 includes a source start pulse GSP, a source shift clock SSC, a source output enable SOC, and a polarity signal POL. The timing controller 30 rearranges the output Ro, Go and Bo data supplied from the picture quality improving unit 42 and supplies the rearranged output data to the data driver 24.

The DC/DC converter 34 increases or decreases the voltage level of a 3.3 V signal received from the power supply 32 and generates a voltage to be supplied to the liquid crystal panel 22. The DC/DC converter 34 generates a gamma reference voltage, a gate high voltage VGH, a gate low voltage VGL, and a common voltage Vcom.

The inverter 36 supplies the backlight 38 with a drive voltage (or drive current) corresponding to a brightness control signal (Dimming) supplied from the picture quality improving unit 42. In other words, the drive voltage (or drive current) supplied from the inverter 36 to the backlight 38 is determined by the brightness control signal (Dimming) supplied from the picture quality improving unit 42. The backlight 38 supplies the liquid crystal panel 22 light with a brightness level corresponding to the drive voltage (or drive current) supplied from the inverter 36.

The picture quality improving unit 42 extracts a brightness component by using the input Ri, Gi and Bi data received from the system 40 and generates output Ro, Go, and Bo data which is used to change the gray scale value of the input Ri, Gi, and Bi data corresponding to the extracted brightness component. The picture quality improving unit 42 generates the brightness control signal (Dimming) corresponding to the brightness component and supplies the brightness control signal (Dimming) to the inverter 36. Further, the picture quality improving unit 42 generates output vertical/horizontal synchronization signals Vsync2 and Hsync2, a output clock signal DCLK2 and a output data enable signal DE2 synchronized to the Ro, Go, and Bo output data by using the input vertical/horizontal synchronization signal Vsync1 and Hsync1, a input clock signal DCLK1, and a input data enable signal DE1 received from the system 40.

Figure 3:
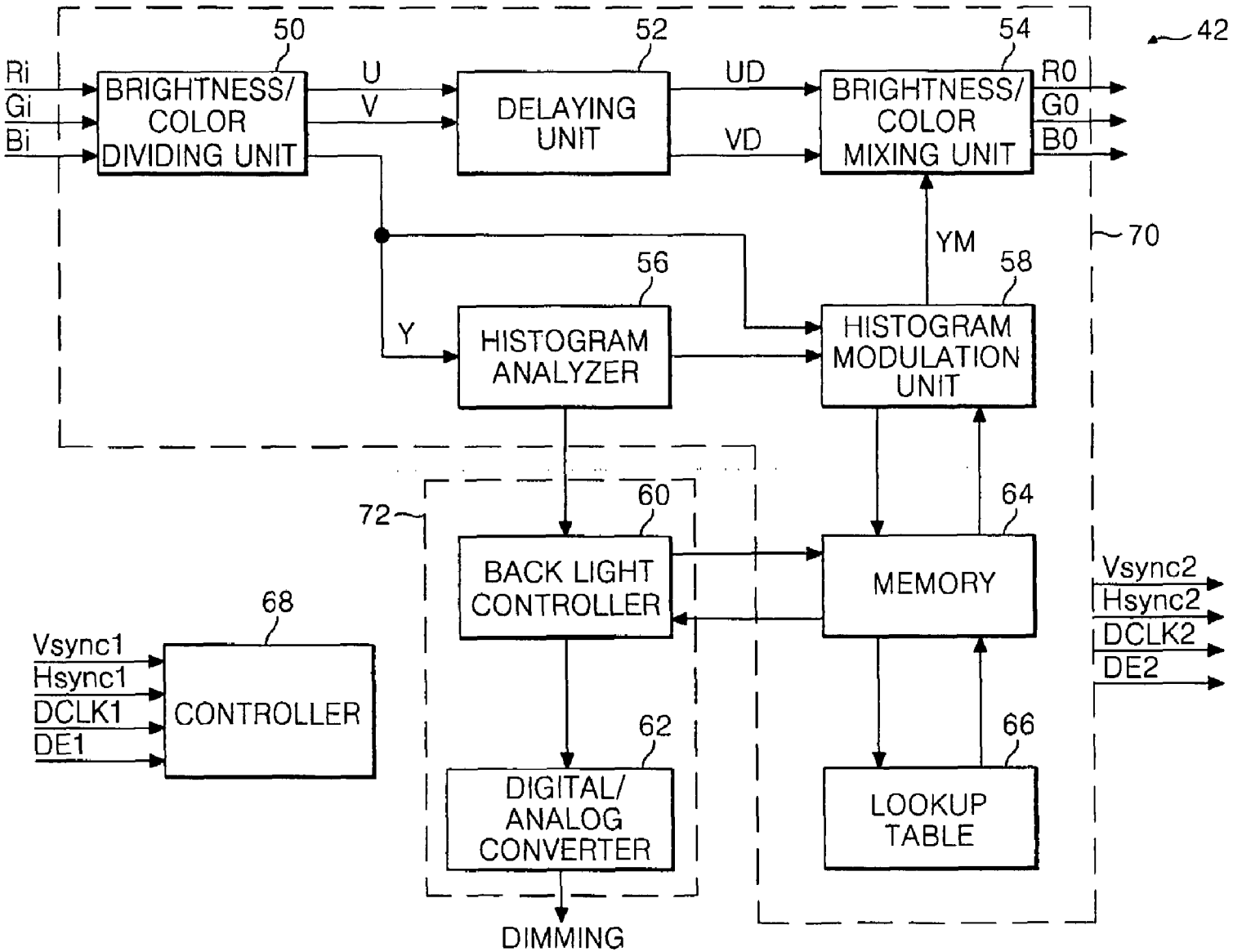
FIG. 3 is a block diagram illustrating a picture quality improving unit according to the present invention.

FIG. 3 shows a picture quality improving unit 42 that includes a image signal modulation unit 70 that generates the Ro, Go, and Bo output data by using the input Ri, Gi, and Bi data, a backlight control unit 72 that generates the brightness control signal (Dimming), and a controller 68 that generates the output vertical/horizontal synchronization signals Vsync2 and Hsync2, the output clock signal DCLK2, and the output data enable signal DE2.

The image signal modulation unit 70 extracts a brightness component Y from the input Ri, Gi and Bi data and generates the output Ro, Go and Bo data having a gray scale value changed by the extracted brightness component Y. The image signal modulation unit 70 includes a brightness/color dividing unit 50, a delaying unit 52, a brightness/color mixing unit 54, a histogram analyzer 56, a histogram modulation unit 58, a memory 64, and a lookup table 66.

The brightness/color dividing unit 50 divides the input Ri, Gi, and Bi data into the brightness component Y and color-difference components U and V. Herein, the brightness component Y and the color-difference components U and V are defined by Equations 1 to 3.

$$Y=0.229\times Ri+0.587\times Gi+0.114\times Bi \quad \text{[Equation 1]}$$

$$U=0.493\times(Bi-Y) \quad \text{[Equation 2]}$$

$$V=0.887\times(Ri-Y) \quad \text{[Equation 3]}$$

The histogram analyzer 56 takes the brightness components Y from a number of data samples in a frame and creates a histogram indicating the gray scale distribution of a frame. In other words, the histogram analyzer takes each brightness component and places it in a bin indicating a certain brightness level and thereby determines the number of pixels that fall within certain brightness levels. Brightness information of the image may be obtained by analyzing the histogram. For example, if the histogram is shifted to right (high gray scale), this indicates a bright picture, and if the histogram is shifted to left (low gray scale), that indicates a dark picture. The histogram analyzer 56 analyzes the histogram of the brightness component (Y) from a frame to determine the brightness information for that frame (e.g a minimum value, a maximum value, and an average value of the brightness). Further, the histogram analyzer 56 supplies a control signal corresponding to the brightness information to the backlight control unit 72. If the histogram indicates a brighter image, a higher drive voltage (drive current) is supplied to the backlight 38.

The histogram modulation unit 58 receives the brightness information and the histogram from the histogram analyzer 56 to generate modulated brightness components YM for the frame. The modulated brightness components YM are determined from data stored in the lookup table 66 and the brightness information for the frame.

Stored in the lookup table 66 is a variety of data corresponding to various sets of brightness information. In other words, the data of various brightness histogram patterns are stored in the lookup table 66, so that the contrast may be extended according to the brightness information from the frame.

Figure 4:
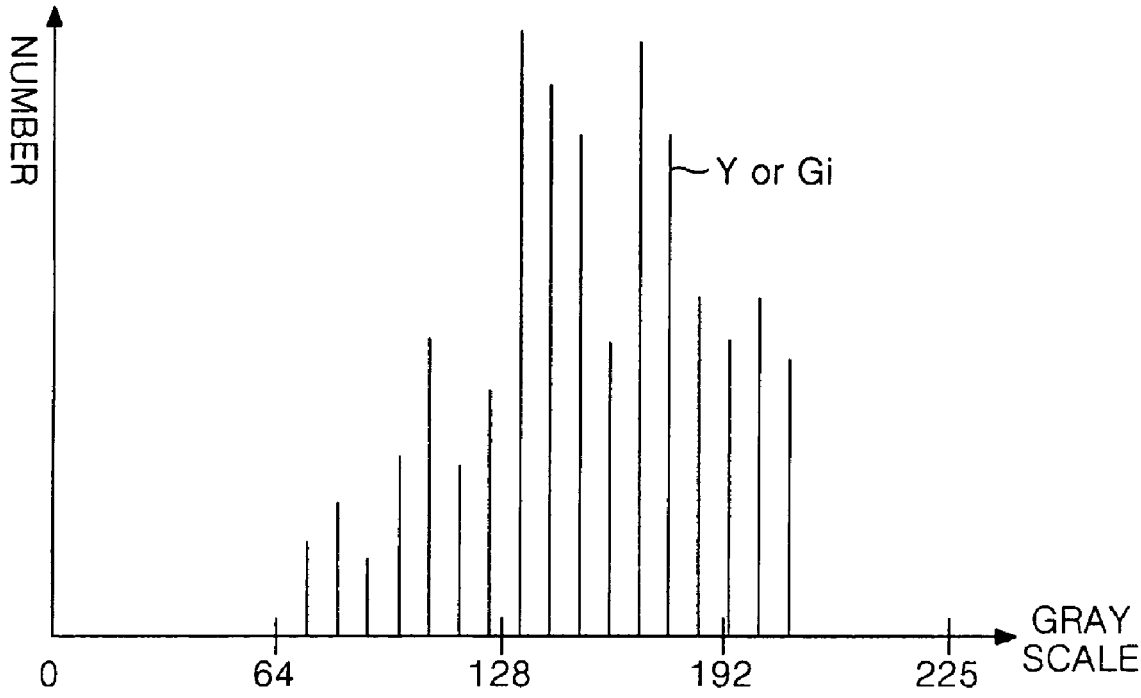
FIG. 4 illustrates an operation process of the histogram analyzer shown in FIG. 3.
Figure 5:
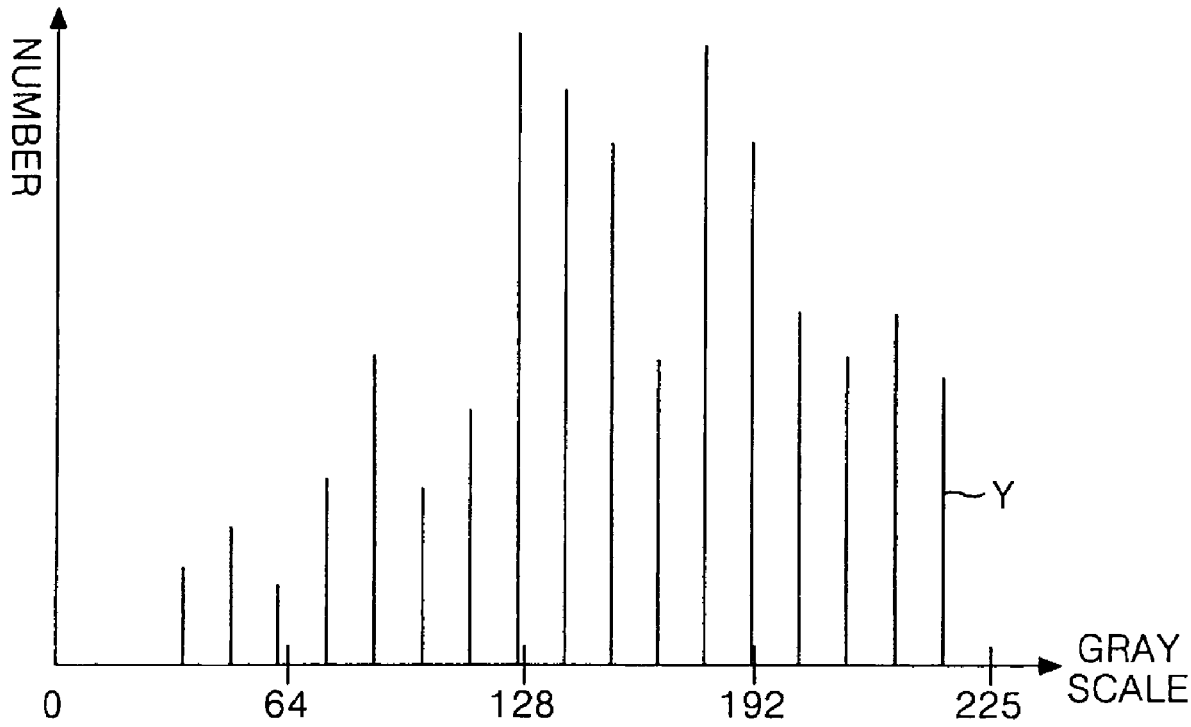
FIG. 5 illustrates the operation of a histogram modulation unit shown in FIG. 3.
Figure 6:
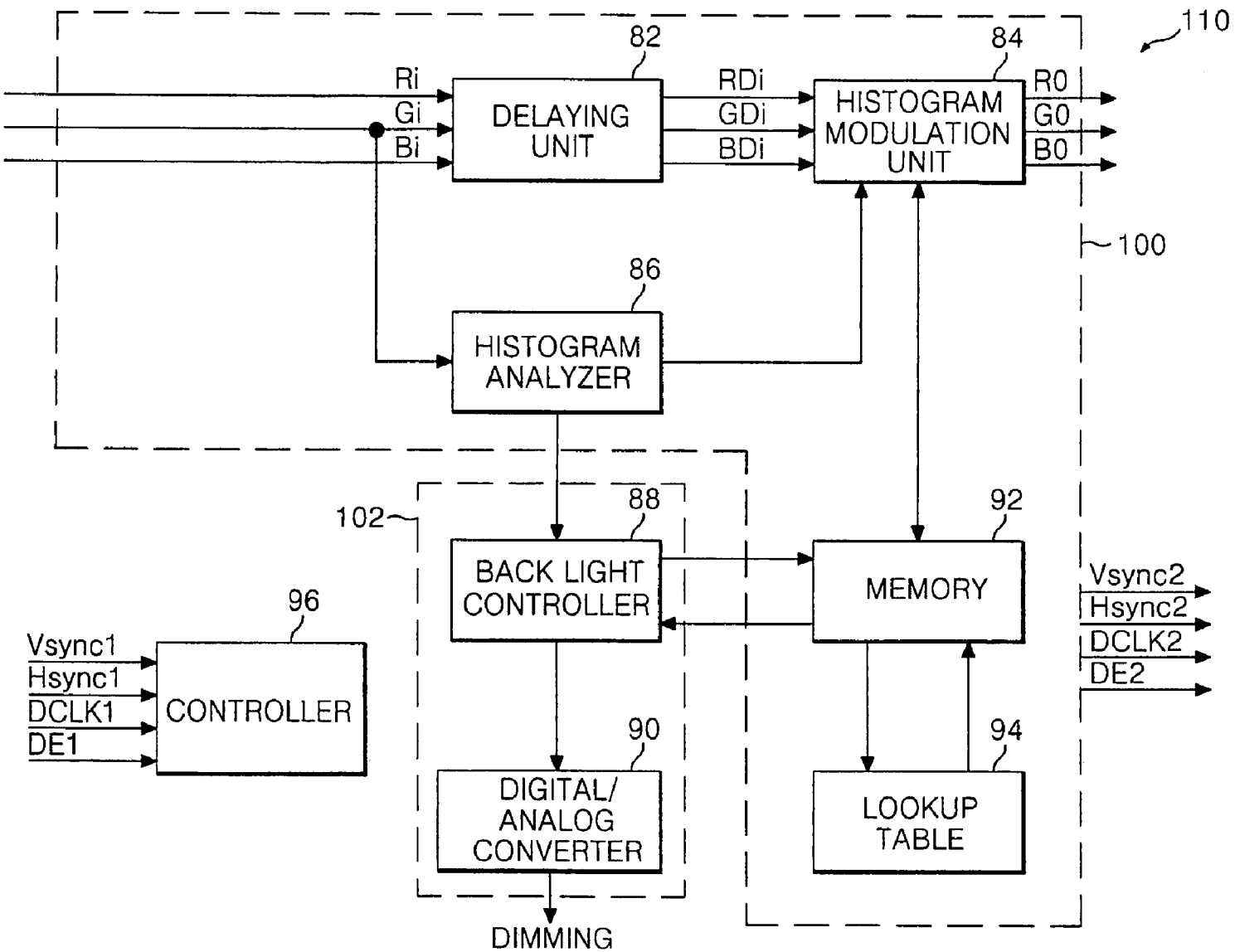
FIG. 6 is a block diagram illustrating another embodiment of a picture quality improving unit according to the present invention.

For example, in FIG. 4, the histogram shows a distribution of the brightness component from about 64 to about 210. The brightness values may range from 0 to 255, so the historgram shows a frame that exhibits less contrast than is possible. The histogram analyzer unit 58 recognizes this limited contrast range, and the histogram modifies the brightness components Y into modulated brightness components YM. FIG. 5, shows how the brightness values Y in FIG. 4 are modified into modulated brightness values YM. The histogram in FIG. 5 shows modulated brightness values YM that range from about 30 to 240. The distribution of the brightness values has been spread out over a greater range of grayscale values, thus the modulated brightness values result in an image with greater contrast. As the modulated brightness values are spread further out, the contrast increases.

The histogram modulation unti 58 uses brightness information from the histogram analyzer 56 to extract information from the lookup, table 66 stored in memory 64 to modulate the brightness values Y into modulated brightness values YM. The information in the lookup table may be calculated or determined experimentally, so as to expand the contrast in the modulated image. It is noted that the lookup table 66 is shown apart from the memory 64 in order to more easily explain the invention.

The delaying unit 52 delays the color-difference components U and V while the brightness component Y is analyzed in the histogram analyzer 56 and the histogram modulation unit 58. Then the delaying unit 52 synchronizes the modulated brightness components YM with the delayed color-difference components UD and VD and supplies them to the brightness/color mixing unit 54.

The brightness/color mixing unit 54 generates the output data Ro, Go, and Bo by using the modulated brightness component YM and the delayed color-difference components UD and VD. The output data Ro, Go and Bo are determined by the Equations 4 to 6.

$$Ro=YM+1.140\times VD \quad \text{[Equation 4]}$$

$$Go=YM-0.396\times UD-0.581\times VD \quad \text{[Equation 5]}$$

$$Bo=YM+2.029\times UD \quad \text{[Equation 6]}$$

The operation of the image signal modulation unit 70 will be further explained in greater detail. First of all, the brightness/color dividing unit 50 divides the input data Ri, Gi, and Bi according to Equations 1 to 3 into the brightness component Y and the color-difference components U and V. The brightness component Y is provided to the histogram analyzer 56 and the color-difference components U and V are provided to the delaying unit 52.

The histogram analyzer 56 develops a histogram of the brightness components Y for the frame basis and analyzes the brightness information (e,g. a minimum value, a maximum value and an average value of the brightness) from the histogram of the brightness component Y values. Then, the histogram analyzer 56 generates a control signal based upon the brightness information to drive the backlight 38 and then supplies the generated control signal to the backlight control unit 72. The histogram analyzer 56 also supplies the brightness information and the histogram information to the histogram modulation unit 58.

The histogram modulation unit 58 uses the lookup table 66 to modulate the brightness components Y into modulated brightness components YM to increase the contrast of the image frame. The histogram modulation unit 58 generates the modulated brightness components YM and supplies it to the brightness/color mixing unit 54.

The brightness/color mixing unit 54, in response to the delayed color-difference components UD and VD and the modulated brightness component YM generates the output data Ro, Go, and Bo according to Equations 4 to 6. Because the output data Ro, Go, and Bo are generated using the modulated brightness component YM, greater contrast is achieved. That is, the present invention spreads out the brightness components YM across the entire gray scale region to generate the output data Ro, Go, and Bo resulting in more vivid pictures on the liquid crystal panel 22. In other words, the bright colors become brighter, and the dark colors become darker. Thus the contrast is improved.

The backlight control unit 72 of the present invention generates a brightness control signal (Dimming) corresponding to the control signal supplied from the histogram analyzer 56 and supplies the brightness control signal (Dimming) to the inverter 36. The backlight control unit 72 includes a backlight controller 60 and a digital to analog converter 62.

The backlight controller 60 generates a digital control signal in accordance with the control signal supplied from the histogram analyzer 56. The backlight controller 60 generates the digital control signal so that the light based upon the analysis of the brightness component Y in the histogram analyzer to achieve a desired brightness level from the backlight 38. More specifically, if the brightness component Y analyzed in the histogram analyzer 56 indicates a high brightness, the backlight controller 60 generates the digital control signal in order to produce a high brightness out of the backlight. However if the brightness component Y analyzed in the histogram analyzer 56 indicates a low brightness, the backlight controller 60 generates the digital control signal in order to produce of a low brightness out of the backlight.

The digital to analog converter 62 converts the digital control signal into the analog control signal (Dimming) and supplies the analog control signal to the inverter 36. The inverter 36, in response to the bright control signal (Dimming), supplies the drive voltage (or the drive current) corresponding to the brightness control signal (Dimming) to the backlight 38. The backlight 38 produces light with a brightness corresponding to the drive voltage (or the drive current) supplied from the inverter 36 and supplies it to the liquid crystal panel 22. That is, the backlight controller 60 of the present invention controls the light output level of the backlight 38 so that bright colors are displayed more brightly and the dark colors are displayed more darkly, whereby the pictures display increased contrast on the liquid crystal panel 22.

The controller 68 of the present invention receives the input vertical/horizontal synchronization signals Vsync1 and Hsync1, the input clock signal DCLK1, and the input data enable signal DE1 provided from the system 40. And the controller 68 generates the output vertical/horizontal synchronization signals Vsync2 and Hsync2, the output clock signal DCLK2, and the output data enable signal DE2 in order to be synchronized with the output data Ro, Go, and Bo, and the controller 68 supplies them to the timing controller 30.

The liquid crystal display apparatus according to the present invention increases the contrast of the image by using the brightness component Y of the data to thereby display more dynamic and more vivid pictures. However, the liquid crystal display apparatus according to an embodiment of the present invention as described above has a limitation in that a loss of color arises during the modulation of the data. The present invention generates the brightness component Y and the color-difference components U and V by using the input data Ri, Gi, and Bi and generates the output data Ro, Go, and Bo by using the modulated brightness component YM and the color-difference components UD and VD. During the processing of the inut data, Ri, Gi, and Bi into the output data Ro, Go, and Bo, the colors are changed. Additionally, more components are necessary to convert the input data Ri, Gi, and Bi into the brightness/contrast components Y, V, and U and then into the output data Ro, Go, and Bo thereby increasing the manufacturing cost and complexity.

In order to improve upon the embodiment described above, FIG. 6 shows a picture quality improving unit 110 according to another embodiment of the present invention. The picture quality improving unit 110 detects the brightness in the frame by using the input green data Gi received from the system 40 and then performs a gamma compensation of the input data Ri, Gi, and Bi in accordance with the detected brightness to produce the output data Ro, Go, and Bo. The picture quality improving unit 110 generates the brightness control signal (Dimming) corresponding to the detected brightness and supplies it to the inverter 36. Further, the picture quality improving unit 110 generates output vertical/horizontal synchronization signals Vsync2 and Hsync2, a output clock signal DCLK2, and a output data enable signal DE2 synchronized with the output data Ro, Go, and Bo based upon the input vertical/horizontal synchronization signal Vsync1 and Hsync1, the output clock signal DCLK1, and the output data enable signal DE1 received from the system 40.

The picture quality improving unit 110 includes an image signal modulation unit 100 that generates the output data Ro, Go, and Bo by using the input data Ri, Gi, and Bi, a backlight control unit 102 that generates the brightness control signal (Dimming) under the control of an image signal modulation unit 100, and a controller 96 that generates the output vertical/horizontal synchronization signals Vsync2 and Hsync2, the output clock signal DCLK2, and the output data enable signal DE2.

The image signal modulation unit 110 detects the brightness of the input frame by using the input green data Gi and generates the output data Ro, Go, and Bo by gamma compensation so that the contrast is improved based upon the detected brightness value. The image signal modulation unit 110 includes a histogram analyzer 86, a delaying unit 82, a histogram modulation unit 84, a memory 92, and a lookup table 94.

The histogram analyzer 86 takes the input green data Gi and produces a histogram of gray scale values for the frame. The histogram analyzer 86 processes the input green data Gi and produces a data histogram, for example as shown in FIG. 4. The brightness information for the frame is determined by analyzing the histogram.

As shown in Equation 1, about 60% of the total brightness component Y is determined by the input green data Gi. Generally, the brightness of a frame is mostly determined by the green data. Accordingly, the brightness information of the image may be determined by using only the input green data. A frame excluding the input green data Gi leaves only the pure Red R and blue B colors. Red and blue combine to form magenta, which does not significantly contribute to a bright picture.

The histogram analyzer 86 determines whether the average brightness of the image signal is more than a predetermined reference value; if so, the frame is considered to be a bright picture, and if not, the frame is considered to be a dark picture. The reference value may be calculated or determined through experimentation. While an image has a fixed brightness, the brightness recognized by various users is different. Accordingly, the reference value according to the present invention maybe experimentally determined by considering the brightness perceived by the users. If the analyzed image is identified as a dark image (i.e. the average brightness below the reference value), the histogram analyzer 86 does not supply the control signal to the histogram modulation unit 84 and the backlight control unit 102. However, if the analyzed image has an average brightness more than the reference value, the histogram analyzer 86 supplies the control signal to the histogram modulation unit 84 and the backlight control unit 102.

The delaying unit 82 delays the input data Ri, Gi, and Bi while the brightness component is analyzed in the histogram analyzer 86. Then, the delaying unit 82 supplies the delayed input data RDi, GDi, and BDi to the histogram modulation unit 84 after the brightness component is analyzed in the histogram analyzer 86.

Figure 7:
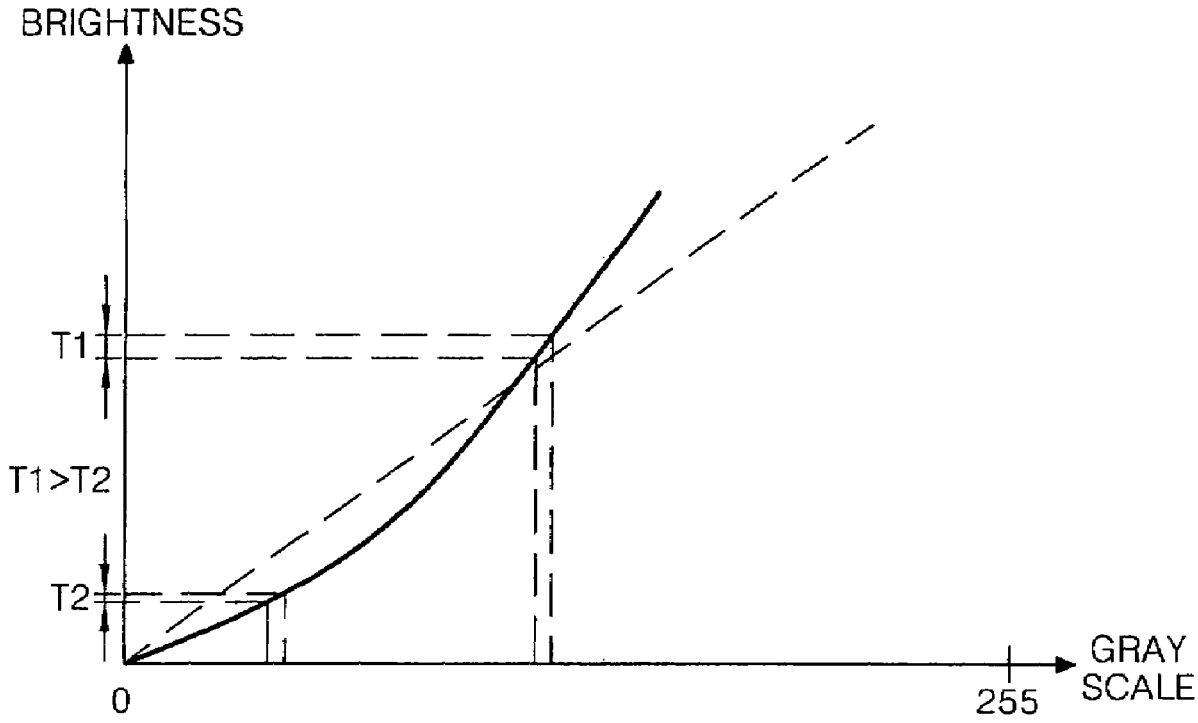
FIGS. 7 and 8 illustrate the operation of a histogram modulation unit shown in FIG. 6.

The histogram modulation unit 84 performs the gamma compensation for the input images RDi, GDi and BDi by using the lookup table 94 when the control signal is provided from the histogram analyzer 86. However, the control signal is not present, the histogram modulation unit 84 provides the input image RDi, Gdi, and BDi without modification. The histogram modulation unit 84 performs the gamma compensation so that the contrast of the input image is emphasized. For example, if the histogram analyzed in the histogram analyzer 86 is a bright image, the histogram is shifted towards the right i.e. the average brightness is more than the reference value. In this case, the histogram modulation unit 84, as shown in FIG. 7, performs the gamma compensation by using a gamma curve with a high slope for compensating the high gray scale values and performs the gamma compensation by using a gamma curve with a low slope for compensating low gray scale values. As a result, image data points with high gray scale values become brighter and image data point values with low gray scale values become darker, whereby the contrast is increased, i.e., the brightness difference throughout the image is increased.

Figure 8:
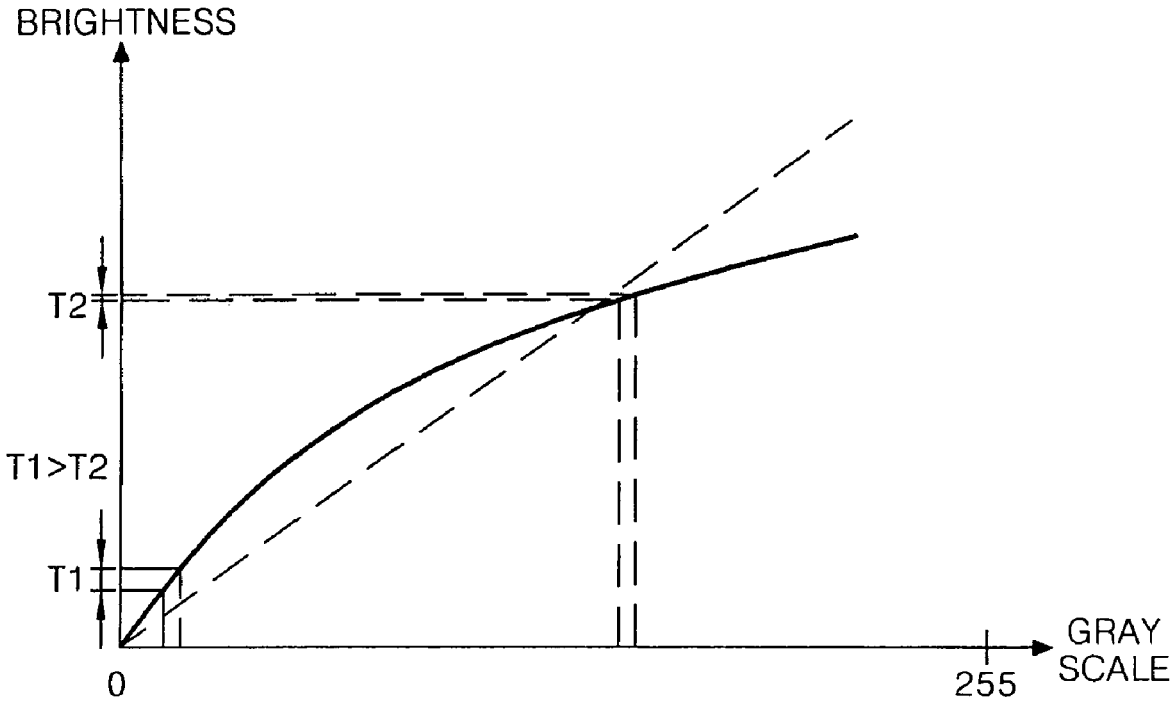

Further, if the histogram analyzed in the histogram analyzer 86 is a dark image the histogram is shifted towards the left i.e., the average brightness is more than the reference value. In this case, the histogram modulation unit 84, as shown in FIG. 8, performs the gamma compensation by using a gamma curve with a high slope for compensating the low gray scale values and performs the gamma compensation by using a gamma curve with a low slope for compensating the high gray scale values. Accordingly, the brightness difference throughout the image is increased, and thus, the contrast is increased. Further, the histogram modulation unit 84 applies a gamma compensation by using a gamma curve with a high slope where the most gray scale values are concentrated and applies a gamma compensation by using a gamma curve with a low slope where the gray scale values are least concentrated.

Additionally, various data corresponding to the histogram analysis information maybe stored in the lookup table 94. In other words, characteristics of various histogram patterns are stored in the lookup table 94, so that the contrast may be extended according to the analysis information of the histogram. For example, the gamma curves as shown in FIGS. 7 and 8 may be is stored in the lookup table. The modulated data stored in the lookup table 94 may be calculated or experimentally determined so that the contrast is increased in correspondence with various histograms. The lookup table 94 may be stored in the memory 92. The memory 92 and the lookup table 94 are illustrated as separate elements herein in order to more easily explain the lookup table 94 and the memory 92.

The operation of the image signal modulation unit 100 will be further explained in greater detail. First of all, the histogram analyzer 86 produces a histogram of the input green data Gi for the frame and detects the brightness information of the image from the histogram. If the average brightness of the frame determined from the histogram is higher than the reference value, a control signal is supplied to the histogram modulation unit 84 and the backlight control unit 102. However, if the average brightness of the frame determined from the histogram is lower than the reference value, a control signal is not provided to the histogram modulation unit 84 and the backlight control unit 102.

The delaying unit 82 delays the input data Ri, Gi, and Bi until the histogram is produced and analyzed in the histogram analyzer 86 and then supplies the delayed input data RDi, Gdi, and BDi to the histogram modulation unit 84.

If the control signal is not received from the histogram analyzer 86, the histogram modulation unit 84 outputs the delayed input data RDi, Gdi, and BDi as the output data Ro, Go, and Bo without modulating the delayed input data Rdi, Gdi, and Bdi. However, if the control signal is received from the histogram analizer 86, the histogram modulation unit 84 performs the gamma compensation on the delayed input data RDi, GDi and BDi by using the lookup table 94 to generate the output data Ro, Go, and Do. The gamma compensation emphasizes the contrast of the image and to display a more vivid image on the LCD display.

According to another embodiment of the present invention, if the control signal is produced by the histogram analyzer 86, the backlight control block 102 generates the brightness control signal (Dimming) and supplies it to the inverter 36. However, if the control signal is not produced by the histogram analyzer 86, the backlight control signal 102 does not generate the brightness control signal (Dimming). The backlight control unit 102 includes a backlight control unit 88 and a digital to analog converter 90.

If the control signal is produced by the histogram analyzer 86, the backlight control unit 88 generates a digital control signal corresponding to the control signal. When the control signal is supplied the image has an average brightness more than reference value. In this case, the backlight control part 88 generates the digital control signal so that the backlight generates a light intensity level proportional to the brightness signal.

Alternatively, the backlight control unit 88 may generate the digital control signal so that the light intensity level is inversely proportional to the brightness signal. If a light intensity level inversely proportional to the brightness signal is generated by the backlight 38, an image similar to that on a cathode ray tube may be displayed on the liquid crystal panel 22. The digital to analog converter 90 converts the digital control signal into an analog control signal (Dimming) (i.e. the brightness control signal) which is supplied to the inverter 36. The inverter 36, in response to the brightness control signal (Dimming), supplies the drive voltage (or the drive current) corresponding to the brightness control signal (Dimming) to the backlight 38. The backlight 38 generates a light intensity level corresponding to the drive voltage (or the drive current) supplied from the inverter 36 to illuminate the liquid crystal panel 22. Otherwise, the inverter 36 supplies a predetermined driving voltage to the backlight 38 if the brightness control signal is not provided thereto.

The backlight control unit 102 according to another embodiment of the present invention controls the data so that a light intensity level corresponding to the brightness component of the data is supplied to the liquid crystal panel 22, to thereby display a dynamic and vivid image on the liquid crystal panel 22.

The control unit 96 is supplied with the input vertical/horizontal synchronization signal Vsync1 and Hsync1, the clock signal DCLK1, and the input data enable signal DE1 from the system 40. The control unit 96 then generates the output vertical/horizontal synchronization signals Vsync2 and Hsync2, the output clock signal DCLK2, and the output data enable signal DE2 in order to synchronize the output data Ro, Go, and Bo and to supply them to the timing controller 30.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An apparatus for driving a liquid crystal display having a data driver, comprising:

a picture quality improving unit that receives input data for a frame, wherein the picture quality improving unit analyzes green input data to determine a brightness of the frame and performs a gamma compensation on the input data in accordance with the brightness of the frame to generate output data; and a timing controller that rearranges the output data to supply the rearranged output data to the data driver.

2. The apparatus for driving the liquid crystal display according to claim 1, wherein the picture quality improving unit receives an external input synchronization signal and modifies the received external input synchronization signal to synchronize the output data in the timing controller.

3. The apparatus for driving the liquid crystal display according to claim 1, wherein if the average brightness of the input data for the frame is higher than a predetermined reference value, the picture quality improving unit performs the gamma compensation on the input data.

4. The apparatus for driving the liquid crystal display according to claim 3, wherein the predetermined reference value is experimentally determined.

5. The apparatus for driving the liquid crystal display according to claim 3, wherein the predetermined reference value is calculated.

6. The apparatus for driving the liquid crystal display according to claim 3, wherein a gamma curve with a high slope is used in the gamma compensation of high brightness input data and a gamma curve with a low slope is used in the gamma compensation of low brightness input data.

7. The apparatus for driving the liquid crystal display according to claim 3, further comprising:

a backlight; and an inverter that controls the brightness of the backlight, wherein if the average of the analyzed brightness of the input data is higher than the predetermined reference value, the picture quality improving unit generates and supplies a control signal to the inverter.

8. The apparatus for driving the liquid crystal display according to claim 7, wherein the inverter, in response to the control signal, generates a driving voltage to increase the brightness of the backlight.

9. The apparatus for driving the liquid crystal display according to claim 7, wherein the inverter, in response to the control signal, generates a driving voltage to decrease the brightness of the backlight.

10. An apparatus for driving a liquid crystal display having a data driver and a gate driver, comprising:

an image signal modulation unit that analyzes input green data from input data for a frame to determine the brightness of the frame and that generates output data, wherein the brightness of the output data has been changed in accordance with the analyzed brightness to increase the contrast of the frame;

a controller that modulates an input synchronization signal associated with the input data to generate a output synchronization signal to synchronize the output data; and a timing controller that rearranges the output data and that generates a driving control signal to be supplied to the data driver and the gate driver by using the output synchronization signal.

11. The apparatus for driving the liquid crystal display according to claim 10, wherein the image signal modulation unit comprises:

a histogram analyzer that produces a brightness histogram of the input green data of the frame to detect brightness information for the frame and that generates a histogram brightness control signal when an average brightness of the frame indicated by the histogram is higher than a predetermined reference value;

a delaying unit that delays the input data until the histogram analyzer detects the brightness information;

a histogram modulation unit that gamma compensates the delayed input data according to the histogram brightness control signal to generate the output data; and a lookup table that stores modulation data for gamma curves used in the gamma compensation.

12. The apparatus for driving the liquid crystal display according to claim 11, wherein the predetermined reference value is experimentally determined.

13. The apparatus for driving the liquid crystal display according to claim 11, wherein the histogram modulation unit performs the gamma compensation in order to increase contrast in the frame.

14. The apparatus for driving the liquid crystal display according to claim 11, wherein the histogram modulation unit performs the gamma compensation by using a gamma curve with a high slope for the brightness values corresponding to the largest amount of input data, and wherein the histogram modulation unit performs the gamma compensation by using a gamma curve with a low slope for the brightness values corresponding to the smallest amount of input data.

15. The apparatus of driving the liquid crystal display according to claim 14, wherein a gamma curve with a high slope is used in the gamma compensation of high brightness input data and a gamma curve with a low slope is used in the gamma compensation of low brightness input data.

16. The apparatus for driving the liquid crystal display according to claim 14, wherein if the histogram represents a dark picture, the histogram modulation unit performs the gamma compensation by using the gamma curve with high slope in the picture having a low gray scale and performs the gamma compensation by using the gamma curve with the low slope in the picture having a high gray scale.

17. The apparatus for driving the liquid crystal display according to claim 11, further comprising:

a backlight control unit connected to the histogram analyzer that generates an inverter brightness control signal corresponding to the histogram brightness control signal when the histogram brightness control signal is supplied thereto;

an inverter that supplies to the backlight a drive voltage corresponding to the inverter brightness control signal supplied from the backlight controller; and a backlight that generates a light brightness level corresponding to the drive voltage supplied from the inverter.

18. The apparatus for driving the liquid crystal display according to claim 17, wherein if the histogram brightness control signal is supplied to the backlight controller, the backlight controller generates the inverter brightness control signal for the inverter so that the light level generated by the backlight is increased.

19. The apparatus for driving the liquid crystal display according to claim 17, wherein when the histogram brightness control signal is supplied to the backlight controller, the backlight controller generates the inverter brightness control signal for the inverter so that the light level generated by the backlight is decreased.

20. The apparatus of driving the liquid crystal display according to claim 17, wherein if the histogram brightness control signal is not supplied to the backlight controller, the backlight controller does not generate the inverter brightness control signal, and if the inverter does not receive the brightness control signal, the inverter supplies a predetermined drive voltage to the backlight.

21. The apparatus for driving the liquid crystal display according to claim 17, further comprising a digital to analog converter installed between the backlight controller and the inverter for converting the inverter brightness control signal supplied from the backlight controller into an analog brightness control signal.

22. A method of driving a liquid crystal display having a data driver, comprising the steps of:

producing a brightness histogram using input green data of input data from a frame that indicates brightness information;

performing a gamma compensation of the input data in order to increase contrast of the frame if an average value of the brightness information is higher than a predetermined reference value; and rearranging the compensated input data to supply to the data driver.

23. The method of driving according to claim 22, wherein the predetermined reference value is experimentally determined.

24. The method of driving according to claim 22, wherein the step of performing the gamma compensation performs the gamma compensation by using a gamma curve with a high slope for the brightness values corresponding to the largest amount of input data, and wherein the histogram modulation unit performs the gamma compensation by using a gamma curve with a low slope for the brightness values corresponding to the smallest amount of input data.

25. The method of driving according to claim 22, further comprising the step of controlling the brightness of the backlight if the average value of the brightness information is higher than the reference value.

26. The method of driving according to claim 25, wherein the brightness of the backlight is increased if the average value of the brightness information is higher than the reference value.

27. The method of driving according to claim 25, wherein the brightness of the backlight is decreased if the average value of the brightness information is higher than the reference value.

28. The method of driving according to claim 22, further comprising the step of synchronizing input synchronization signals received with the gamma-compensated data.

* * * * *